United States Patent [19]

Simons et al.

[11] Patent Number: 4,640,879

[45] Date of Patent: Feb. 3, 1987

[54] COPYING PROCESS AND ELECTROPHOTOGRAPHIC ELEMENT UTILIZING A PHOTOCONDUCTIVE PIGMENT DISPERSED IN AN IMPROVED POLYMERIC BINDER

[75] Inventors: Petrus A. M. R. Simons, Roermond; Wilhelmus J. Bouts, Reuver, both of Netherlands

[73] Assignee: Oce-Nederland B.V., Venlo, Netherlands

[21] Appl. No.: 763,053

[22] Filed: Aug. 6, 1985

[30] Foreign Application Priority Data

Sep. 13, 1984 [NL] Netherlands ..... 8402805

[51] Int. Cl.[4] ..... G03G 5/05

[52] U.S. Cl. ..... 430/96; 430/126

[58] Field of Search ..... 430/96, 87, 90, 126

[56] References Cited

U.S. PATENT DOCUMENTS 3,929,480 12/1975 Perlis et al. ..... 430/87

4,492,747 1/1985 Brechlin ..... 430/96

FOREIGN PATENT DOCUMENTS 1510200 5/1978 United Kingdom ..... 430/90

*Primary Examiner*—John L. Goodrow

*Attorney, Agent, or Firm*—Reed Smith Shaw & McClay

[57] ABSTRACT

An electrophotographic element and an indirect electrophotographic process for producing copies are described wherein the electrophotographic element contains a photoconductive pigment dispersed in a binder, the binder being a copolymer of an acrylic or methacrylic acid ester monomer, a vinyl aryl monomer, and 1% to 3% by weight unsaturated acid, such that 2.5 to 6.0 parts by weight of copolymerized vinyl aryl monomer are present per part by weight of copolymerized acrylic or methacrylic acid ester monomer. After repeated use of this electrophotographic element, the contours of smaller sized images do not become visible on larger sized images produced after the smaller images.

8 Claims, No Drawings

COPYING PROCESS AND ELECTROPHOTOGRAPHIC ELEMENT UTILIZING A PHOTOCONDUCTIVE PIGMENT DISPERSED IN AN IMPROVED POLYMERIC BINDER

BACKGROUND OF THE INVENTION

1. Field of the Invention

The present invention relates to a process for producing copies in which a transferable image is formed on an electrophotographic element having a photoconductive layer. The transferable image is formed on the electrophotographic element by charging, exposing image-wise, and developing with a developing powder. Then, the image is transferred onto copy material whereupon it is fixed. More specifically, the invention relates to an electrophotographic element used in the above process comprising a photoconductive pigment dispersed in a binder consisting substantially of a copolymer of an acrylic or methacrylic acid ester monomer, a vinyl aryl monomer and 1% to 3% by weight unsaturated acid.

2. Description of the Prior Art

A method of producing copies using the above-described process and electrophotographic element has been disclosed in the prior art. For example, a process of this kind is described in United Kingdom Pat. No. 1,510,200 and its corresponding Dutch Patent Application No. 7,611,130. The electrophotographic element described in this United Kingdom Patent has a photoconductive layer comprising zinc oxide dispersed in a polymeric binder such as the copolymer of styrene ethyl acrylate. The preferred styrene ethyl acrylate copolymer for electrophotographic use is marketed under the name Synolac 620S and contains a copolymer of styrene, ethyl acrylate, and acrylic acid in the ratio of 1.5:1.0:0.025.

The use of zinc oxide dispersed in a polymeric binder as the photoconductive layer in an electrophotographic element is known in the prior art. U.S. Pat. No. 3,929,480, teaches the use of acrylic or alkyd polymer resins or a mixture of both as the polymeric binder in a photoconductive layer. This patent, however, teaches the use of specific polymer resins such poly-α-methyl styrene as an additive to improve the optical qualities and does not include an unsaturated acid such as acrylic acid. Similarly, Japanese Patent Abstract No. 57-202544 describes a polymeric binder consisting of 2-hydroxy ethyl acrylate, acrylic acid, styrene, and (meth)acrylic ester. It is evident from the Japanese abstract that the ratio of styrene to acrylic or methacrylic acid ester monomer is about 1.5 to 1.0, the same as in Synolac 620S.

When an electrophotographic element containing Synolac of the type described in United Kingdom Pat. No. 1,510,200 is used in a process in which images of different sizes are formed successively on the electrophotographic element and then transferred onto copying material with heat, aging of the electrophotographic element becomes visible. Typically, a contour of a smaller image becomes visible on a larger image that is formed on the same place of the electrophotographic element after the smaller image. The various circumstances surrounding this phenomenon, which hereafter will be referred to as format outlining, are only partially known. The phenomenon is visible on large size copies and usually occurs after 1,000 to 10,000 copies have been made and is caused by the fact that the parts of the photoconductive layer on which images of large and small sizes coincide are used more frequently than the parts on which only an image is formed when large copies are made. The phenomenon is not visible when copies of only one size, either large or small, are made exclusively.

SUMMARY OF THE INVENTION

Generally, the present invention provides a copying process using an electrophotographic element which does not suffer from the disadvantage of format outlining. The present invention relates to an electrophotographic element and a process for producing copies in which a transferable image is formed on an electrophotographic element having a photoconductive layer. The transferable image is formed on the electrophotographic element by charging, exposing image-wise, and developing with a developing powder. Then, the image is transferred onto copy material whereupon it is fixed. More specifically, the invention relates to an electrophotographic element used in this copying process comprising a photoconductive pigment dispersed in a binder consisting substantially of a copolymer of an acrylic or methacrylic acid ester monomer, a vinyl aryl monomer, and 1% to 3% by weight unsaturated acid.

If a process and an electrophotographic element of the type described above are used, format outlining, surprisingly, does not occur if the copolymer in the photoconductive layer of the electrophotographic element comprises 2.5 to 6.0 parts by weight of copolymerized vinyl aryl monomer per part by weight of copolymerized acrylic or methacrylic acid ester monomer.

DESCRIPTION OF THE PREFERRED EMBODIMENTS

The present invention particularly provides a copying process using an electrophotographic element wherein the electrophotographic layer comprises 2.5 to 6.0 parts by weight of copolymerized vinyl aryl monomer per part by weight of copolymerized acrylic or methacrylic acid ester monomer. Format outlining does not occur if the copolymerized vinyl aryl monomer content in conventional copolymers is increased up to 2.5 to 4.0 parts by weight per part by weight of copolymerized acrylic or methacrylic acid ester monomer. A further increase of the vinyl aryl monomer content up to 6.0 parts by weight per part by weight of copolymerized acrylic or methacrylic acid ester monomer has only slight additional effects on the electrophotographic properties.

Preferably, the vinyl aryl monomer in the copolymer is styrene but other monomers can be used, such as vinyl toluene, α-methyl styrene, and chlorostyrene. Ethyl acrylate is the preferred ester monomer, but methyl acrylate, propyl acrylate, butyl acrylate, isobutyl acrylate, methyl methacrylate, or ethyl methacrylate may also be used as the ester monomer. The copolymerized, unsaturated acid may be acrylic acid, methacrylic acid, crotonic acid, maleic acid, or other similar acids.

Format outlining is relatively unaffected by the nature of the photoconductive pigment dispersed in the copolymer. A very suitable photoconductive pigment is zinc oxide or the so-called pink zinc oxide. Pink zinc oxide is obtained by treating zinc oxide with carbon dioxide and ammonia until the weight has increased by 6%, followed by heating it at about 150° C. to 250° C. to a constant weight as described in United Kingdom Pat. No. 1,489,793. These zinc oxides can be used in the conventional quantities known to those in the art of 3.0 to 7.0 parts by weight per part by weight of binder.

The photoconductive pigment can be sensitized in any known manner by means of a known sensitizing dye such as bromo phenol blue, Rose Bengal, and the like. The concentration of the sensitizing dye is that conventionally used in the art and may be between 1.0 mg and 6.0 mg per gram of photoconductive pigment.

The photoconductive layer can be applied to any support suitable for electrophotographic purposes. The support can either be electrically conductive or be provided with an electrically conductive layer. For example, a polyester film provided on both sides with either a metal layer or a carbon binder layer makes a very suitable support.

The present invention will be explained in detail by reference to the following examples.

EXAMPLE 1

A copolymer containing styrene and ethyl acrylate in the ratio of about 2.6:1.0 was prepared by polymerization of the following mixture for 24 hours at a temperature of 110° C.:

2072 g styrene;
800 g ethyl acrylate;
59.5 g acrylic acid;
1960 g toluene;
59 g of a mixture of dibenzoyl peroxide and a phthalate in the proportion of 1:1;
14.5 g ditertiary butyl peroxide.

A support consisting of a polyester film coated on both sides with a layer consisting of carbon and a vinyl butyral polymer in the proportions of 1:1 by weight was made. On one side of this support, a dispersion of the following composition was provided:

70 parts by weight pink zinc oxide;
0.28 parts by weight bromo phenol blue;
17.5 parts by weight of the copolymer obtained in the manner described hereinabove (parts by weight of solid);
4.2 parts by weight isopropanol;
83.3 parts by weight toluene.

After drying, the weight of the photoconductive layer thus obtained was 28 g per $m^2$.

The electrophotographic element obtained as described above was placed in a copying machine in which, successively, images of different sizes were formed on the element by charging, exposing image-wise, and developing with an electrically conductive one-component developer. The images were transferred onto copy paper by means of a silicone rubber intermediate that was heated to a temperature of 110° C. Even after 40,000 copies of different sizes had been made, no format outlining appeared, whereas the same photoconductive element containing a copolymer of styrene and ethyl acrylate in the ratio of 1.5:1.0 exhibited format outlining after just a few thousand copies.

EXAMPLE 2

A copolymer containing styrene and ethyl acrylate in the ratio of about 4.0:1.0 was prepared by polymerization of the following mixture for 24 hours at a temperature of 110° C.:

2330 g styrene;
574 g ethyl acrylate;
59.5 g acrylic acid;
1960 g toluene;
59 g of a mixture of dibenzoyl peroxide and a phthalate in the proportion of 1:1;
14.5 g ditertiary butyl peroxide.

An electrophotographic element was produced with this copolymer in the same way as described in Example 1. This electrophotographic element was placed in the same copying machine as in Example 1, and 40,000 copies of different sizes were made without any format outlining occurring.

While presently preferred embodiments of the invention have been described in particularity, the invention may be otherwise embodied within the scope of the appended claims.

What is claimed is:

1. A copying process in which a transferable image is formed by charging, exposing image-wise, developing with a developing powder and then transferred onto a copying material whereupon it is fixed, wherein the transferable image is formed on an electrophotographic element comprising a support and a photoconductive layer comprising a photoconductive pigment dispersed in a binder consisting substantially of a copolymer of an acrylic or methacrylic acid ester monomer, a vinyl aryl monomer, and 1% to 3% by weight unsaturated acid wherein 2.5 to 6.0 parts by weight of copolymerized vinyl aryl monomer are present per part by weight of copolymerized acrylic or methacrylic acid ester monomer.

2. A process according to claim 1, wherein the copolymer binder in the photoconductive layer comprises 2.5 to 4.0 parts by weight of copolymerized vinyl aryl monomer per part by weight of copolymerized acrylic or methacrylic acid ester monomer.

3. A process according to claim 1, wherein the vinyl aryl monomer is styrene and the acrylic or methacrylic acid ester monomer is ethyl acrylate.

4. A process according to claim 2, wherein the vinyl aryl monomer is styrene and the acrylic or methacrylic acid ester monomer is ethyl acrylate.

5. An electrophotographic element comprising a support and a photoconductive layer comprising a photoconductive pigment dispersed in a binder consisting substantially of a copolymer of an acrylic or methacrylic acid ester monomer, a vinyl aryl monomer, and 1% to 3% by weight of unsaturated acid, wherein 2.5 to 6.0 parts by weight of copolymerized vinyl aryl monomer are present per part by weight of copolymerized acrylic or methacrylic acid ester monomer.

6. An electrophotographic element according to claim 5, wherein the copolymer comprises 2.5 to b 4.0 parts by weight of copolymerized vinyl aryl monomer per part by weight of copolymerized acrylic or methacrylic acid ester monomer.

7. An electrophotographic element according to claim 5, wherein the vinyl aryl monomer is styrene and the acrylic or methacrylic acid ester monomer is ethyl acrylate.

8. An electrophotographic element according to claim 6, wherein the vinyl aryl monomer is styrene and the acrylic or methacrylic acid ester monomer is ethyl acrylate.

* * * * *